US009960498B2

(12) United States Patent
Clayton et al.

(10) Patent No.: US 9,960,498 B2
(45) Date of Patent: May 1, 2018

(54) FOLDABLE RADIO WAVE ANTENNA

(71) Applicant: Cubic Corporation, San Diego, CA (US)

(72) Inventors: William R. Clayton, Huntsville, AL (US); Paul A. Gierow, Madison, AL (US)

(73) Assignee: Cubic Corporation, San Diego, CA (US)

( * ) Notice: Subject to any disclaimer, the term of this patent is extended or adjusted under 35 U.S.C. 154(b) by 632 days.

(21) Appl. No.: 14/334,374

(22) Filed: Jul. 17, 2014

(65) Prior Publication Data

US 2016/0020523 A1 Jan. 21, 2016

(51) Int. Cl.
*H01Q 15/16* (2006.01)
*H01Q 19/13* (2006.01)

(52) U.S. Cl.
CPC ..... *H01Q 15/161* (2013.01); *H01Q 19/132* (2013.01)

(58) Field of Classification Search
CPC ... H01Q 15/161; H01Q 19/132; H01Q 15/163
See application file for complete search history.

(56) References Cited

U.S. PATENT DOCUMENTS

| | | | | |
|---|---|---|---|---|
| 3,176,303 | A | 3/1965 | Holland | |
| 3,978,490 | A | 8/1976 | Fletcher et al. | |
| 4,168,504 | A | 9/1979 | Davis | |
| 4,490,726 | A | 12/1984 | Weir | |
| 4,527,166 | A | 7/1985 | Luly | |
| 4,672,389 | A | 6/1987 | Ulry | |
| 4,683,475 | A * | 7/1987 | Luly | H01Q 15/161 343/915 |
| 4,755,819 | A | 7/1988 | Bernasconi et al. | |
| 4,926,181 | A | 5/1990 | Stumm | |
| 5,255,006 | A | 10/1993 | Pappas et al. | |
| 5,574,472 | A | 11/1996 | Robinson | |
| 5,597,631 | A | 1/1997 | Furumoto et al. | |
| 5,968,641 | A | 10/1999 | Lewis | |
| 6,340,956 | B1 | 1/2002 | Bowen et al. | |
| 6,373,449 | B1 | 4/2002 | Bokulic et al. | |
| 6,624,796 | B1 * | 9/2003 | Talley | H01Q 1/288 343/912 |
| 7,710,348 | B2 | 5/2010 | Taylor et al. | |
| 8,259,033 | B2 | 9/2012 | Taylor et al. | |
| 2006/0033674 | A1 * | 2/2006 | Essig, Jr. | A01K 61/007 343/912 |
| 2006/0270301 | A1 | 11/2006 | Marks | |

(Continued)

FOREIGN PATENT DOCUMENTS

| | | | |
|---|---|---|---|
| CN | 101847786 | A | 9/2010 |

OTHER PUBLICATIONS

Non-Final Office Action dated May 18, 2017 for U.S. Appl. No. 14/883,392, filed Oct. 14, 2015; all pages.

(Continued)

*Primary Examiner* — Graham Smith
*Assistant Examiner* — Noel Maldonado
(74) *Attorney, Agent, or Firm* — Kilpatrick Townsend and Stockton, LLP

(57) ABSTRACT

A foldable radio wave antenna includes a foldable parabolic reflector member formed a foldable tension member attachable to the peripheral rim of the reflector member.

26 Claims, 3 Drawing Sheets

(56) References Cited

U.S. PATENT DOCUMENTS

| | | | | |
|---|---|---|---|---|
| 2011/0095956 | A1* | 4/2011 | Conrad | H01Q 1/08 343/840 |
| 2013/0069849 | A1 | 3/2013 | Toledo | |

OTHER PUBLICATIONS

International Search Report and Written Opinion dated Oct. 5, 2015 for International Patent Application No. PCT/US2015/040884 filed Jul. 17, 2015; all pages.

* cited by examiner

FOLDABLE RADIO WAVE ANTENNA

BACKGROUND

Field

The present disclosure relates generally to radio wave antennas, and particularly to foldable radio wave antennas.

Description of the Problem and Related Art

Transport of radio wave systems that use some form of electromagnetic reflecting antenna, i.e., radar or communications, is cumbersome, partially because of the antenna. Such antennas require an electromagnetically reflective substance, a metal, to operate, which has meant that the antenna is heavy and not easily stowed for transport. Collapsible metal antennas have often been used. Of course, these antennas are weighty and require complex actuator systems to be deployed.

Recently, antennas have been formed from lightweight materials such as composites, and polymers. These render the antenna light in weight compared to metal versions, but such antennas need other structures to maintain the shape of the reflector in a parabolic dish when the antenna is deployed in order not to degrade or inhibit the electromagnetic signal.

Often such antennas include rigid members to maintain the shape of the reflector, for example, a plurality of rigid ribs, as described in U.S. Pat. No. 3,978,490 to Talley, et al.; U.S. Pat. No. 7,710,348 to Taylor, et al.; and U.S. Pat. No. 8,259,033 to Taylor, et al. Other antennas employ other "rigidizing" means, such a rigid toroidal member incorporated in the periphery of the reflector dish shown in U.S. Pat. No. 4,755,819 to Bernasconi, et al. in which the antenna reflector comprises an uncured resin in the undeployed state and a toroidal member, both of which are that configured to be inflated to deploy the reflector. When the resin encounters heat from the sun, the reflector hardens and maintains its shape. U.S. Pat. No. 6,272,449 to Bokulic, et al., also discloses a flexible antenna incorporating an inflating toroid. Still other antennas incorporate some other rigid structures to maintain the reflector's shape. For example, U.S. Pat. No. 6,642,796 to Talley, et al. discloses an antenna that includes a rigid center with bendable sections extending from the edge of the rigid center.

These rigidizing members these latter "light-weight" antennas still add weight to the antenna system and require accommodations for space of any non-flexible, or non-folding structures. Even the inflatable versions require systems and plumbing to inflate the structures, adding more weight and complexity to the system.

Accordingly, a foldable antenna that does not require such rigid components is needed.

BRIEF DESCRIPTION OF THE DRAWINGS

The apparatus is described with reference to the accompanying drawings. In the drawings, like reference numbers indicate identical or functionally similar elements.

DETAILED DESCRIPTION

Figure 1:
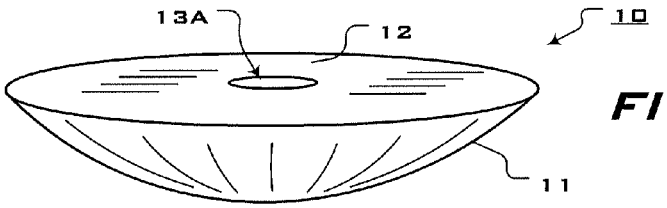
FIG. 1 illustrates an exemplary embodiment of a foldable radio wave antenna.
Figure 2:
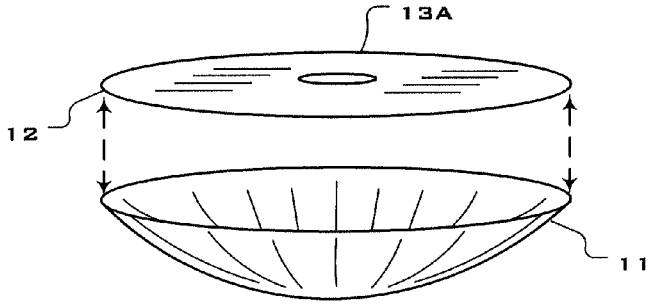
FIG. 2 is an exploded view of the components of the foldable antenna of FIG. 1.
Figure 3:
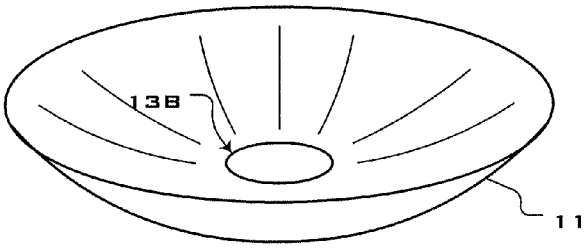
FIG. 3 shows the concave side of an exemplary foldable reflector.

The various embodiments of the foldable antenna and their advantages are best understood by referring to FIGS. 1 through 8 of the drawings. The elements of the drawings are not necessarily to scale, emphasis instead being placed upon clearly illustrating the novel features and principles of operation. Throughout the drawings, like numerals are used for like and corresponding parts of the various drawings.

Furthermore, reference in the specification to "an embodiment," "one embodiment," "various embodiments," or any variant thereof means that a particular feature or aspect described in conjunction with the particular embodiment is included in at least one embodiment. Thus, the appearance of the phrases "in one embodiment," "in another embodiment," or variations thereof in various places throughout the specification are not necessarily all referring to its respective embodiment.

A foldable antenna 10 comprises a reflector member 11 and a tension member 12. Reflector member 11 is a generally parabolic dish having an opening 13*b* defined through its wall and centered at the vertex of the parabola. The tension member 12 is circular in shape and also includes an opening 13*a* defined through it at its center.

The material comprising the reflector member 11 is a composite of woven fibers having a high elastic modulus, e.g., fiberglass, carbon fiber or aramid, and an elastomer binder matrix, for example, silicone, polyurethane, or synthetic rubber. The fiber composite layer could also be a composite of cloth or paper with a phenolic resin as would be appreciated by those skilled in the relevant arts.

A suitable reflector member 11 must exhibit a low flexural elastic modulus, a high tensile modulus, possessing "shape memory", i.e., a tendency to return to its parabolic shape, but with a very low tendency to set when deformed so that the antenna may be used repeatedly without deterioration of signal quality.

The parabolic shape preferably has a relatively high depth-to-diameter ratio, i.e., focal point/diameter (f/d), of between about 0.25 to about 0.30, and confers an automatic increase in short-range and long-range moment of inertia as it unfolds.

Of course, since it is intended to function as an electromagnetic reflector, the reflector member 11 also comprises an electromagnetically reflective fabric, for example, metal-nylon mesh. In one embodiment, reflector member 11 comprises a laminate of an electromagnetically reflective fabric encased in multiple layers of a fiber composite, an elastomer layer, and an aramid. In order to ensure a uniform flexion in all directions, the fibers of each fiber composite layer may be oriented at an offset with respect to adjacent or nearby fiber composite layers. For example, the fibers of a first fiber composite layer may be oriented in a first orientation. The next fiber composite layer may be oriented such that its fibers are angularly offset by about 45° relative the orientation of the fibers of the first layer. The succeeding fiber composite layer may be oriented such that its fibers are angularly offset by about 45° relative the fibers of the preceding layer, and so on.

Thickness of the resulting laminate should be sufficient to be resilient and retain shape memory of the parabolic considering the diameter of the reflector. For example, if the laminate is not thick enough, it will not hold its shape when it is deployed. If it is too thick, the reflector will not be pliant enough to fold. For a reflector diameter of 0.9 m, a suitable thickness is about 50 mils.

Figure 8:
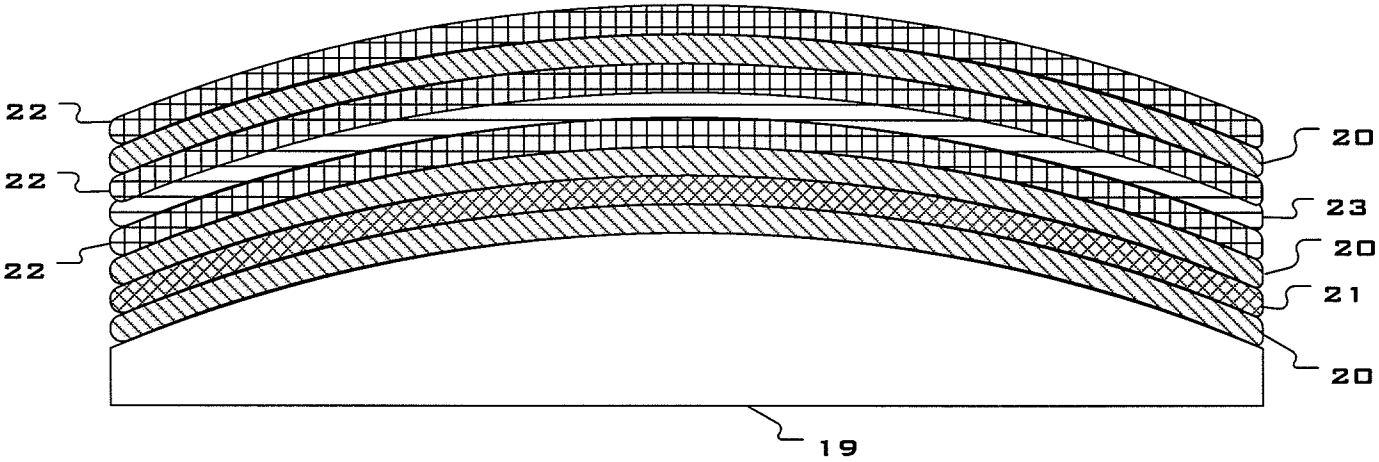
FIG. 8 illustrates an exemplary laminate comprising the reflector member.

With reference to FIG. 8, the reflector member 11 may be formed by laying the multiple layers of material over a mandrel 19 of the desire f/d ratio. The first layer in this example is a fiber composite layer 20 and is overlaid with a metal nylon mesh layer 21. Another fiber composite layer 20 overlays the mesh layer 21 and an elastomer layer 22. An aramid layer 23 is then placed over which is laid another fiber composite layer 20 sandwiched between elastomer layers 22. More layers of fiber composite 20 and elastomer 22 may be added. As will be appreciated by those skilled in the art, the layers, in some embodiments, may be bonded together using heat, a vacuum or combinations of both.

Figure 5:
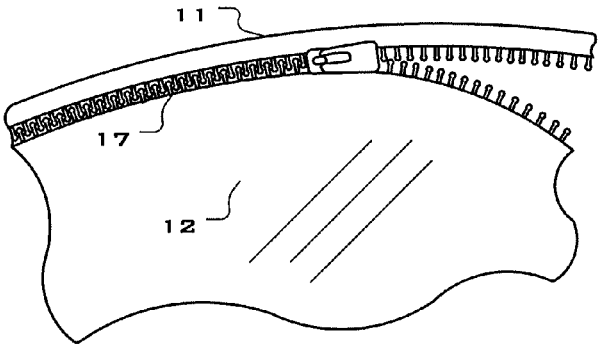
FIG. 5 depicts one means of attaching the tension member to the foldable reflector member.
Figure 6:
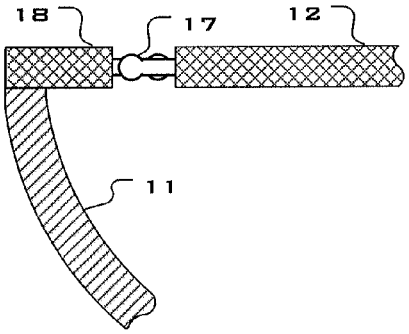
FIG. 6 is a section view of the zipper depicted in FIG. 5.

Tension member 12 is also foldable and may also comprise a laminate of layers of fiber composite and an elastomer binder and may be between about 6 to about 8 mils in thickness having a diameter roughly equal to that of the reflector member 11. In one embodiment, tension member 12 is permanently bonded by its circumferential edge to the peripheral rim of the reflector member 11. In another embodiment, shown in FIG. 2, the tension member 12 may be detachable from the reflector member 11. With reference to FIGS. 5 and 6, a circumferential zipper 17 may be used to attach tension member 12 to the reflector member 11. Once attached, the tension member 12 draws the peripheral rim of the reflector member 11 centrally ensuring the edges maintain a circular shape. This reduces warping in the reflector member's 11 dish shape which degrades antenna performance.

Zipper 17 may be installed by attaching a rim 18 that may comprise the same laminate as that of the tension member 12 to the peripheral rim of the reflector member 11 and attaching one side of the zipper to the radially inward edge of the rim 18. It will be appreciated that preferably zipper 17 comprises an electromagnetically transparent material to avoid interference with the radio wave signals. In addition, other means of attaching the tension member 12 to the reflector member 11 may be employed as will be appreciated by those skilled in the art.

Figure 4:
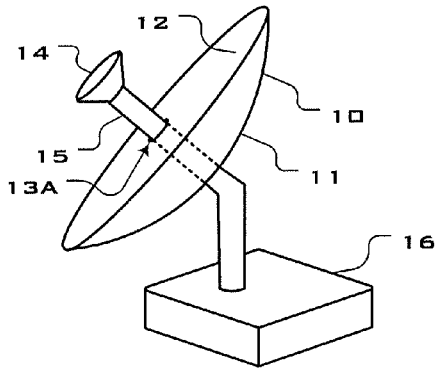
FIG. 4 illustrates an exemplary foldable antenna installed on an exemplary antenna positioning apparatus.

FIG. 4 illustrates the antenna deployed with an antenna control system 16. A mast 15 extends from the control system 16. The antenna 10 is mounted to the mast 15 by inserted the mast 15 through the openings 13*a, b* in the reflector member 11 and the tension member 12. A feed horn 14 is located on the end of the mast 15.

Figure 7:
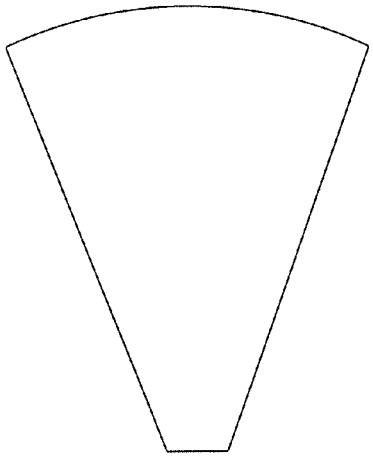
FIG. 7 shows an antenna folded.

When the antenna 10 is to be stowed, it is removed from the mast 15 and the tension member 12 is detached from the reflector member 11. Both the tension member 12 and the reflector member 11 may then be refolded, as illustrated in FIG. 7.

As described above and shown in the associated drawings, the present invention comprises a foldable radio wave antenna. While particular embodiments have been described, it will be understood, however, that any invention appertaining to the antenna described is not limited thereto, since modifications may be made by those skilled in the art, particularly in light of the foregoing teachings. It is, therefore, contemplated by the appended claims to cover any such modifications that incorporate those features or those improvements that embody the spirit and scope of the invention.

What is claimed is:

1. A foldable radio wave antenna comprising:

a foldable reflector member formed in a parabolic dish shape having a peripheral rim; and a foldable tension member having a circumferential edge that is coupled to the peripheral rim of the foldable reflector member such that at least one major surface of the foldable tension member is generally planar with the peripheral rim, the foldable tension member being configured to draw the peripheral rim of the reflector member centrally such that an edge of the peripheral rim maintains a generally circular shape.

2. The foldable radio wave antenna of claim 1, wherein said reflector member comprises a laminate of a fiber composite material, an electromagnetically reflective fabric, an elastomer and an aramid.

3. The foldable radio wave antenna of claim 1, wherein said tension member is a laminate of a fiber composite material and an elastomer.

4. The foldable radio wave antenna of claim 1, further comprising a zipper for attaching and detaching said tension member to said reflector member peripheral rim.

5. The foldable radio wave antenna of claim 1, wherein said reflector member is formed to have a focal point-to-depth ratio of between about 0.25 to about 0.30.

6. The foldable radio wave antenna of claim 1, wherein said reflector member comprises a laminate having a thickness of about 50 mils.

7. The foldable radio wave antenna of claim 6, wherein said reflector member comprises a laminate of a fiber composite material, an electromagnetically reflective fabric, an elastomer and an aramid.

8. The foldable radio wave antenna of claim 1, wherein said tension member is detachable from said reflector member.

9. The foldable radio wave antenna of claim 1, wherein:

the foldable tension member has an annular shape and is concentrically aligned with the foldable reflector member;

the circumferential edge comprises an outer circumferential edge of the annular shape; and the outer circumferential edge is coupled to the peripheral rim of the foldable reflector member such that the foldable tension member spans an interior space defined by the peripheral rim.

10. The foldable radio wave antenna of claim 9, wherein:

the foldable tension member defines a central opening configured to receive a feed horn of the antenna.

11. A radio wave antenna comprising:

a refoldable parabolic reflector having shape memory and comprising a peripheral rim; and a refoldable planar tension member having a circumferential edge that is coupled to the peripheral rim of the reflector such that at least one major surface of the tension member is generally planar with the peripheral rim, the tension member being configured to draw the peripheral rim of the reflector centrally such that an edge of the peripheral rim maintains a generally circular shape.

12. The radio wave antenna of claim 11, wherein said reflector comprises a laminate of a fiber composite, an electromagnetically reflective material and an elastomer.

13. The radio wave antenna of claim 12, wherein said laminate also includes an aramid.

14. The radio wave antenna of claim 11, wherein said tension member is detachable from said reflector.

15. The radio wave antenna claim 11, further comprising a first opening defined in said reflector and a second opening defined in said tension member, said first and second openings for mounting said antenna to an antenna control system.

16. The radio wave antenna claim 15, wherein:

the antenna control system is coupled with a proximal end of a mast that extends from the antenna control system;

the mast is configured to extend through the first opening of the reflector and the second opening in the tension member; and the distal end of the mast is coupled with a feed horn.

17. The radio wave antenna of claim 11, further comprising a feed horn.

18. The radio wave antenna of claim 17, wherein said reflector comprises a laminate of a fiber composite, an electromagnetically reflective fabric and an elastomer.

19. The radio wave antenna of claim 18, wherein said laminate also includes an aramid.

20. The radio wave antenna of claim 19, wherein said tension member is detachable from said reflector.

21. The radio wave antenna of claim 11, wherein:

the foldable tension member is concentrically aligned with the foldable reflector member;

the circumferential edge comprises an outer circumferential edge of the annular shape; and the outer circumferential edge is coupled to the peripheral rim of the foldable reflector member such that the foldable tension member spans an interior space defined by the peripheral rim.

22. The radio wave antenna of claim 21, wherein:

the foldable tension member defines a central opening configured to receive a feed horn of the antenna.

23. A radio wave antenna comprising:

a single piece, pliant parabolic reflector formed from a laminate of a woven fiber composite, an elastomer and an electromagnetically reflective fabric, the reflector comprising a peripheral rim; and a pliant circular, planar member having a circumferential edge that is coupled to the peripheral rim of said reflector such that at least one major surface of the foldable tension member is generally planar with the peripheral rim, wherein:

the pliant circular, planar member is configured to draw the peripheral rim of the reflector member centrally such that an edge of the peripheral rim maintains a generally circular shape; and the circular, planar member comprises a laminate of a woven fiber composite and an elastomer.

24. The radio wave antenna of claim 23, wherein said laminate further comprises an aramid.

25. The radio wave antenna of claim 23, wherein:

the pliant circular, planar member is concentrically aligned with the reflector;

the circumferential edge comprises an outer circumferential edge of the pliant circular, planar member; and the outer circumferential edge is coupled to the peripheral rim of the reflector such that the pliant circular, planar member spans an interior space defined by the peripheral rim.

26. The radio wave antenna of claim 25, wherein:

the pliant circular, planar member defines a central opening configured to receive a feed horn of the antenna.

* * * * *